US005592183A

United States Patent [19]

Henf

[11] Patent Number: 5,592,183

[45] Date of Patent: Jan. 7, 1997

[54] GAP RAIDATED ANTENNA

[76] Inventor: George Henf, 174 Chaloupe Terr., Sebastian, Fla. 32958

[21] Appl. No.: 151,353

[22] Filed: Nov. 12, 1993

Related U.S. Application Data

[63] Continuation-in-part of Ser. No. 852,751, Mar. 17, 1992, abandoned, which is a continuation of Ser. No. 593,284, Oct. 3, 1990, abandoned, which is a continuation of Ser. No. 280,743, Dec. 6, 1988, abandoned.

[51] Int. Cl.[6] ..... H01Q 9/38

[52] U.S. Cl. ..... 343/749; 343/791; 343/830

[58] Field of Search ..... 343/749, 752, 343/790–792, 825, 829–831; H01Q 9/00, 9/04, 9/30, 9/32, 9/38, 9/22

[56] References Cited

U.S. PATENT DOCUMENTS 2,297,512 9/1942 Von Baeyer ..... 343/791
2,486,597 11/1949 Greene ..... 343/791
4,369,449 1/1983 MacDougall ..... 343/790

FOREIGN PATENT DOCUMENTS 2621341 11/1977 Germany ..... 343/791
2814597 10/1979 Germany ..... 343/790

*Primary Examiner*—Michael C. Wimer
*Attorney, Agent, or Firm*—Malin, Haley, DiMaggio & Crosby, PA

[57] ABSTRACT

An antenna for broadcast and reception of electromagnetic waves in which all or a portion of the radiating structure is formed from coaxial cable or a functional equivalent thereof in which an annular opening exists, allowing alternating electrical current to propagate onto the outer surface of said radiative structure, thereby generating electromagnetic radiation.

5 Claims, 9 Drawing Sheets

GAP RAIDATED ANTENNA

This application is a continuation-in-part of application Ser. No. 07/852,751 filed Mar. 17, 1992, now abandoned, which was a continuation of application Ser. No. 07/593,284 filed Oct. 3, 1990, now abandoned, which was a continuation of application Ser. No. 07/280,743 filed Dec. 6, 1988, now abandoned.

BACKGROUND OF THE INVENTION

1. Field of the Invention

This invention relates generally to linear antennas utilized for radio broadcast and reception, specifically to vertical and horizontal single and multiband antennas, horizontal arrays, and shortened antennas for mobile use. The antenna is especially useful for multiband operation on the 80/75 meter, 40 meter, 20 meter, 15 meter, and 10 meter bands.

2. Description of the Prior Art

The fundamental linear antenna is the dipole, which may be oriented horizontally or vertically. In its most basic configuration, it consists of two colinear conducting wires (each of length equal to one-quarter of the operative wavelength—i.e.—"¼"). The antenna is connected at its central point to a source of alternating current oscillating in the radio frequency range (the "rf source"), its two wires being connected at that point to opposite poles of said rf source via an appropriate transmission line. The length of each of the aforesaid wires (¼ λ) as well as the resultant overall length of the dipole (½ λ) has been established to properly phase the current in each with respect to the other.

To conserve on overall height, the lower half of the vertical dipole ("vertical") is commonly discarded and replaced by the ground or Earth's surface. In this situation the ground surface acts as an imaging surface plane. The reflective characteristics of this plane create the replacement for the lower half of the vertical radiator, thereby reducing the total height from ½ λ to ¼ λ. However, in most locations, the Earth's surface is a poor conductor. Thus, it is typically necessary to enhance soil conductivity by placing a wire mesh or a number of radially oriented wires ("radials") beneath the vertical, on or below the surface of the ground. The major portion of the following descriptions addresses the vertical antenna configuration; however, as will be seen, the invention is not limited to verticals, but is equally applicable to horizontal antennas ("horizontals").

The typical vertical, as described above, receives current at its base, one current element being attached to the vertically oriented wire, and one being attached to the radially oriented wires. Current flow is inward on the radials when current flow on the vertically oriented wire is upward, and outward on the radials when current flow on the vertically oriented wire is downward. In order to effect the most efficient transfer of power from the transmission line to the antenna, the impedance of each must be identical. The characteristic impedance of the transmission line is a function of conductor diameter, conductor spacing, and the material which is used to separate the wires. The impedance of the antenna, commonly referred to as "antenna resistance," is actually a measure of its power. The dipole consumes power, but rather than producing heat, it radiates electromagnetic energy.

Although feasible, transmission lines with a multiplicity of different impedances are not available. 52, 75 and 90 ohm lines are the most readily available; however, as most rf sources are 52 ohm devices, 52 ohm transmission line is the most common. It is, therefore, desirable that all antennas have a 52 ohm antenna resistance in order to effect a matched, maximum power transfer. It is also desirable to utilize a single antenna for several wavelengths. Currently, in order to utilize an antenna for more than one wavelength, one of the following methods is employed to adjust the height to ¼ λ: (a) trap isolation; (b) multiple antennas attached to a single structure; and (c) remote controlled motorized tuning assemblies located at the base of a single mast. None of these methods has, however, proved totally satisfactory.

The trap multiband vertical contains a number of hi-impedance, parallel resonant, "traps" inserted in series at the requisite heights on the vertically oriented wire. Each trap effectively disconnects that portion of the antenna above the trap. Amateur radio operators utilize five major wavelengths: 80/75 meters (3.5 to 4 mhz); 40 meters (7 to 7.3 mhz); 20 meters (14 to 14.4 mhz); 15 meters (21 to 21.5 mhz); and 10 meters (28 to 29 mhz). Thus, in a typical antenna operating at these wavelengths, the 10 meter trap is located eight (8) feet above the base (i.e.—one-quarter (¼) of 10 meters, the operative wavelength), and disconnects that portion of the antenna above the trap. The 8 feet utilized is the portion of the antenna closest to the ground with the poorest visibility over nearby objects. However, the lowest 8 feet must be utilized because the antenna is base excited. When a longer wavelength is selected, less of the antenna is discarded, the entire antenna height finally being utilized when the longest wavelength is broadcast.

On the lowest band all the previous traps become loading coils since they are no longer resonant at the lowest frequency. These loading coils force antenna height to be decreased to compensate for its longer length electrically. The shortened antenna then presents a very low antenna resistance, typically in a range from 6 to 10 ohms. An external device like a transformer must now be added to transform this resistance up to 52 ohms. The transformation network required to handle the entire antenna at its various operating wavelengths adds to loss of antenna power. It also becomes very complicated due to the fact that each decrease in wavelength involves another trap and an increased antenna resistance. Under these conditions it is nearly impossible to match antenna resistance and transmission line impedance over all five bands.

Multiple antennas on a single structure and antennas featuring motorized tuning assemblies present two alternate methods of adjusting antenna height. The multiple antenna utilizes a vertical tower constructed such that it has antennas of various heights mounted thereon. As with the trap antenna, it receives current at its base and the total height of the structure is not utilized on each band. However, in comparison to the trap antenna, antenna radiation resistance remains more constant at varying wavelengths. Nonetheless, some variation appears due to the effect one antenna has on another when the two are in close proximity.

The motorized tuning antenna employs a remotely controlled (motorized) assembly that is generally placed at the base of the antenna mast. The tuning antenna contains a variety of rotary, inductive and capacitive assembles that can be remotely controlled via internal motors and gears. Units of this type are expensive because they are complex and require great care in design and fabrication to avoid malfunction due to external conditions such as extremes of temperature, corrosion from salt air, water vapor penetration and destruction from lightning. Further, the units can result in loss of power due to the extreme range of transformation required when a single mast must be matched to 52 ohms.

SUMMARY OF THE INVENTION

The gap radiated antenna in accordance with the invention is one in which certain elements of the radiative structure are comprised of coaxial cable in which a circumferential segment of the shield has been removed, allowing alternating electrical current to exit from the electromagnetically shielded interior of the cable and propagate on the outer surface of same thereby generating electromagnetic radiation. This innovation in combination with other unique and singular qualities arising therefrom as developed by the inventor for use in conjunction with same provides numerous benefits, including the creation of antennas:

(1) That can receive current at a multitude of points along their length by varying the location of the aforesaid circumferential opening in the shield (the "gap").

(2) In which the transmission line forms a portion of the radiating structure.

(3) Having integral inductive and/or capacitive qualities which by proper selection of length, gap location, and other variables can:

(a) Effect a perfect match of antenna resistance and transmission line impedance, thereby allowing 100% efficient power transfer to the antenna where internal transmission line loss is negligible;

(b) Eliminate the need to utilize additional discrete elements such as loading coils in conjunction with the antenna to electrically lengthen same;

(c) Eliminate the need to utilize additional discrete elements in conjunction with the antenna to transform antenna resistance to a higher or lower value in order to facilitate an efficient transfer of power from the transmission line;

(d) Eliminate the need to electrically disconnect physical portions of the linear antenna by the use of traps in order to provide high frequency multiband operation on a single antenna; and (e) By accomplishing those objects set forth in subparagraphs (a) through (d), above, substantially reduce or eliminate the complexity, unreliability, cost, and power losses currently experienced in antenna construction and operation.

(4) In which the total available physical aperture of the antenna may be utilized at all operative wavelengths when functioning as a multiband antenna, thereby optimizing antenna illumination, simplifying multiband design, and creating significant pattern gains when compared with a conventional trap multiband vertical antenna.

(5) That allows the creation of a quasi-top loaded short antenna, with expected improvements in radiation efficiency approaching 700% when compared with current designs.

(6) Configured as multi-element beam arrays in which all elements of the array may be directly grounded to the support beam and tower, reducing fabrication complexity and helping to protect the rf source from the damaging effects of lightning.

(7) That, when functioning as receivers, have demonstrated close to a hundred fold increase, as compared to dipoles or monopoles of identical dimension, in ability to reject electromagnetic energy received that is significantly lower in frequency than the nominal operating frequency of the antenna. These antennas thereby possess a significantly improved capacity to filter unwanted interference.

BRIEF DESCRIPTION OF TEE DRAWINGS

DESCRIPTION OF THE PREFERRED EMBODIMENTS

Figure 1:
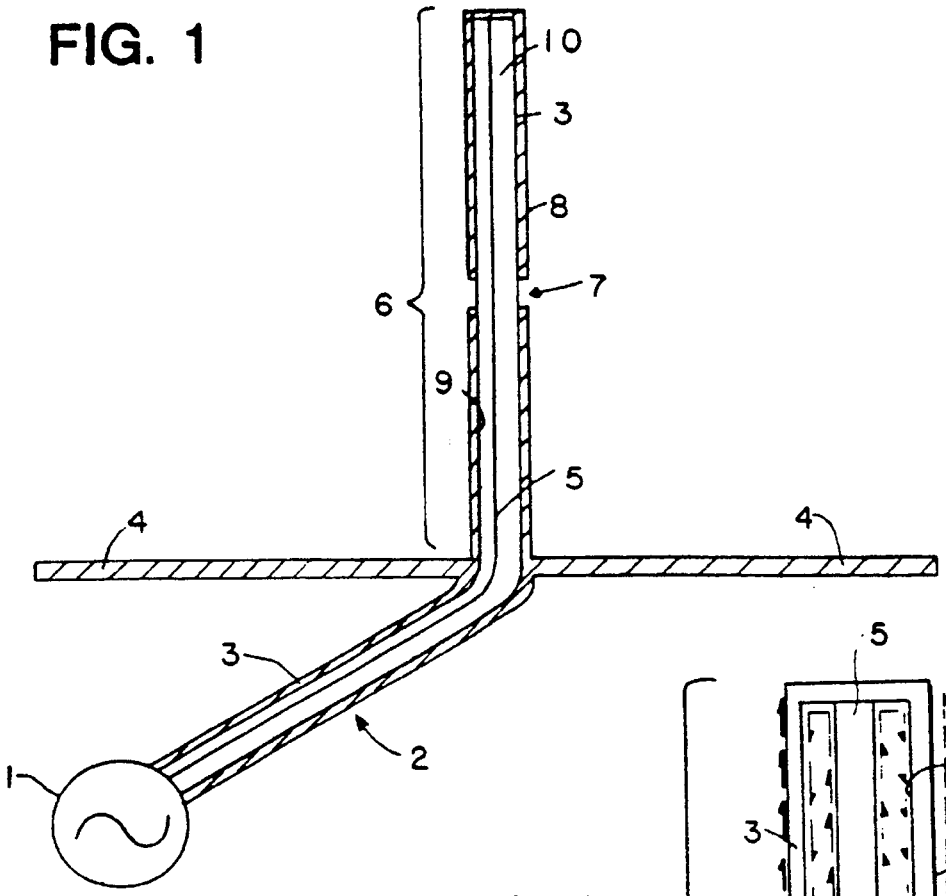
FIG. 1 is a side view in cross-section of a basic single band vertically oriented antenna incorporating the teachings of this invention.

FIG. 1 illustrates the gap radiated antenna in accordance with the invention in a basic vertical configuration. It is similar to a conventional vertical antenna fed by a coaxial cable in several respects. As with a conventional vertical antenna, it is fed by an alternating current source oscillating in the radio frequency range ("rf source") 1. This rf source 1 is linked to the antenna via a transmission line 2 of coaxial cable in which the outer shield (the "braid") 3, connects to the radials 4, and the inner wire 5, continues upward as part of the vertical component 6. For the purposes of this discussion, the shield is uniformly referred to as "braid"; however, this invention may also be used with cable wherein the shield is an extruded solid—i.e.—"hard line." The antenna is however, dissimilar from the conventional vertical in three obvious respects.

First, the radiative element of the vertical component 6 is the braid 3 of the coaxial cable that forms the antenna rather than the inner wire 5. In a conventional vertical, the braid would terminate where contact was made with the radials. The inner wire would then continue upward and form the radiative element of the vertical component 5 with current flow inward on the radials when the current flow on the inner wire is upward, and outward on the radials when the current flow on the inner wire is downward. In the present antenna current movement on the surface of the inner wire 5 contributes little or nothing to the emission of radiation. This role is, instead, taken by the outer surface 8 of the braid 3 in a manner that will be more fully explained in discussing FIG. 2. Second, and most obviously, the coaxial cable which forms the transmission line 2 to the antenna does not end at the radials 4 that form the base of the vertical component 6, as in a conventional vertical, but continues and constitutes the essential element of the vertical component 6. Third, the transmission line 2 is able to play its dual role as transmission line and radiative element by virtue of a small gap 7 in the braid approximately one-half way up the vertical component 6.

As might be concluded by the previous discussion, coaxial cable is a key element of this invention. It has critical capabilities not found in parallel lines:

(1) When utilizing coaxial lines it is possible to have independent rf currents flowing simultaneously on the inside and on the outside of the braid. This is due to the fact that rf currents flow only on the surface of a conductor, with depths of penetration measured in millionths's of an inch. This is not achievable with parallel lines and is critical to the performance of the invention.

(2) It is possible to have unbalanced current flow inside the coaxial shield and yet not radiate electromagnetic energy. The shield will contain the unbalanced condition on the inside of the coaxial cable. Similarly, an unbalanced external condition will not disturb an internal balanced condition.

Figure 2:
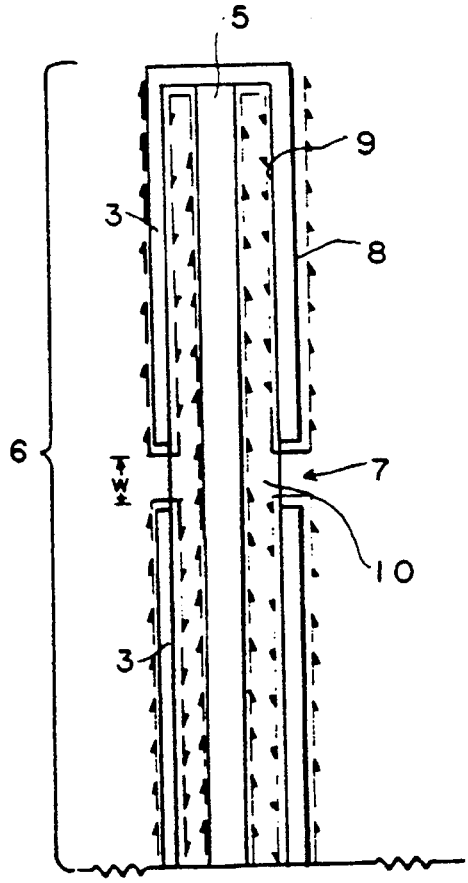
FIG. 2 shows a portion of the vertical component of the antenna illustrated in FIG. 1 in cross section, further illustrating the nature of the gap and of current flow in and on said component.

The role played by these two factors in the operation of the antenna in accordance with the invention can be more fully appreciated by referring to FIG. 2, which provides a cross-sectional view of the vertical component 6. It will first be noted that the braid 3 closes over the top of the vertical component 6 and is grounded to the inner wire 5 at this point. The direction of current flow on the various conducting surfaces at an instant in time when the inner wire is receiving a positive current flow is indicated by arrows. As will be noted, due to the first principle discussed, it is possible to have current flow on the outer surface 8 of the braid 3 opposite in direction to that on the inner surface 9 of same. Moreover, in accordance with the second principle discussed, any lack of balance between current flow on the inner surface 9 of the braid 3 and the inner wire 5 will be contained within the cable. Thus, in the present antenna the outer surface 8 of the braid 3 becomes the radiative element of the vertical component 6. The inner wire 5 and the inner surface 9 of the braid 3 serve merely to transmit energy to same.

The gap 7 that allows the coaxial cable to function as a radiative component is created by removing a small segment of the braid 3 so as to completely sever the braid 3 above the gap 7 from that below it. The inner wire 5 is not disturbed, nor is the coaxial insulator 10 separating the braid 3 from the inner wire 5. The width "w" of the gap 7 is not critical to performance. Gaps wherein "w" ranged between 0.01" and 3" have not materially affected antenna function in tests performed. However, selecting an extremely small value for "w" is unwise for antennas exposed to weather as rain drops could easily bridge and short such a narrow gap. Further, proper function requires "w" to be a minimum value when compared to the height of the vertical component 6 and no particular gain is expected from seeking a maximum value for "w". An intermediate value for the gap width "w" of 2" has, therefore, been selected and employed on all models built to date.

The foregoing analysis and description reveal the more obvious features of this basic configuration of the present antenna. Analysis of those factors involved in determining antenna height, reactance, radiation resistance, and gap location is more complex. However, one of the most important points to be understood in this analysis is the role played by the velocity factor ("vf") of the insulator 10 that surrounds the inner wire 5 and separates it from the braid 3. The plastic materials that are utilized as insulators in coaxial cable slow the propagation of current inside the cable. Thus, while current will propagate at the speed of light on the outer surface 8 of the braid 3, current inside the coaxial cable will propagate at approximately 7/10 (commonly 0.68) of the speed of light. This factor accounts for one of the extremely novel features of this invention: In the present antenna, the use of coaxial cable creates a phase shift equivalent to that created by a multiturn coil, while avoiding the power losses and other problems associated with same.

By providing the equivalent of an inductive reactance in the line, the antenna length is extended electrically. Thus, the actual antenna must be shortened physically to compensate for the added length electrically. This is, of course, equivalent to the addition of a capacitive reactance to the line. The antenna length that will generate a capacitive reactance sufficient to nullify the inductive reactance $X_c$ may be calculated utilizing the following set forth in subparagraph (3), below, which is derived by combining the formula for the capacitance of a short vertical (1) with the general formula for capacitive reactance (2), where "L" is the height of the antenna in feet; "f" is the frequency at which the antenna is to operate in megahertz; "D" is the diameter of the antenna in inches; and $X_c$ is the capacitive reactance:

$$C=\frac{1}{\left[LM\left(\frac{24L}{D}\right)-1\right]-\left[1-\left(\frac{fL}{234}\right)^2\right]} \tag{1}$$

$$X_c=\frac{1}{2\pi fC} \tag{2}$$

$$X_c=\frac{1}{2\pi f\left[\frac{17L}{\left[LN\left(\frac{24L}{D}\right)-1\right]-\left[1-\left(\frac{fL}{234}\right)^2\right]}\right]} \tag{3}$$

Assuming the antenna is powered by a 52 ohm rf source, the reactance to be nullified may be determined by multiplying 52 ohms by the tangent of (Theta/vf) where Theta is the elevation of the gap from the base in electrical degrees. In the configurations shown in FIG. 1 and FIG. 2, where the gap is located at the midpoint (i.e.—Theta=45 degrees) and vf—0.66, the antenna would, accordingly, need to be shortened by 11% to create a capacitive reactance sufficient to nullify the 130 ohm inductive reactance generated. These two reactances would then cancel out, leaving only the antenna radiation resistance.

Antenna radiation resistance varies inversely with the square of the antenna current. Antenna current is equal to $I_{max}$ COS Theta. Thus, as the gap 7 is raised, antenna resistance will increase. Antenna resistance may, therefore, be selected to match line impedance by altering the position of the gap. As the gap is moved, however, different values of inductive reactance will be developed. These will then be required to be nullified by adjusting the height of the antenna as previously discussed.

Figure 3:
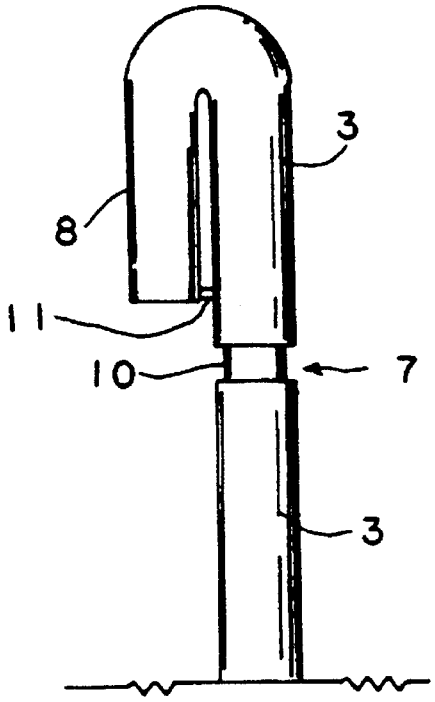
FIG. 3 is a side view of the vertical component of a vertically oriented gap antenna wherein an additional inductive reactance has been generated through lengthening that part of the vertical component above the gap while maintaining the height of the antenna and the position of the gap relative thereto.

It should also be noted that it is not necessary that the inner wire 5 be shortened to the braid 3 at the top of the antenna in order for the present antenna to function. If the antenna terminates with an open circuit, the segment of the antenna above the gap will act as a capacitor. The antenna will then require an extension of length to create inductive reactance sufficient to nullify the capacitive reactance generated. Further, because very short wavelengths are used such that the height of the antenna does not generate sufficient inductive reactance to nullify the capacitive reactance, the antenna may be lengthened while preserving height and gap location relative thereto. In this circumstance, the additional length is folded and shorted to the braid 3 above the gap 7 as illustrated in FIG. 3, where the connector 11 indicates a conducting contact between the outer surfaces 8 of the braid 3 on that portion of the antenna proximate to the gap and that portion farthest removed therefrom.

Figure 4:
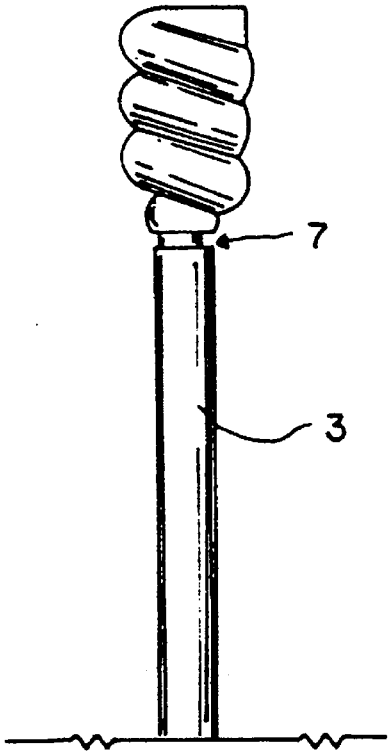
FIG. 4 is a side view of the vertical component of a vertically oriented gap antenna wherein that part of the vertical component above the gap has been coiled, creating a quasi-top loaded antenna.

The segment of the antenna above the gap may also be coiled, as illustrated in FIG. 4. In this circumstance, the section of the antenna above the gap will not radiate. Thus, radiation will be generated only by that part of the current propagating from the gap downward. In this configuration the present antenna will behave much like a "top loaded vertical." This is an antenna configuration that has long been sought by designers, particularly for mobile broadcast uses. Further, in comparison to a conventional base loaded vertical, where maximum current is placed in the loading coil which does not radiate, the quasi-top loaded gap vertical places maximum current in the radiating elements of the antenna. Thus, it is able to achieve extraordinary gains in broadcast power over mobile broadcast antennas currently in use.

Figure 5:
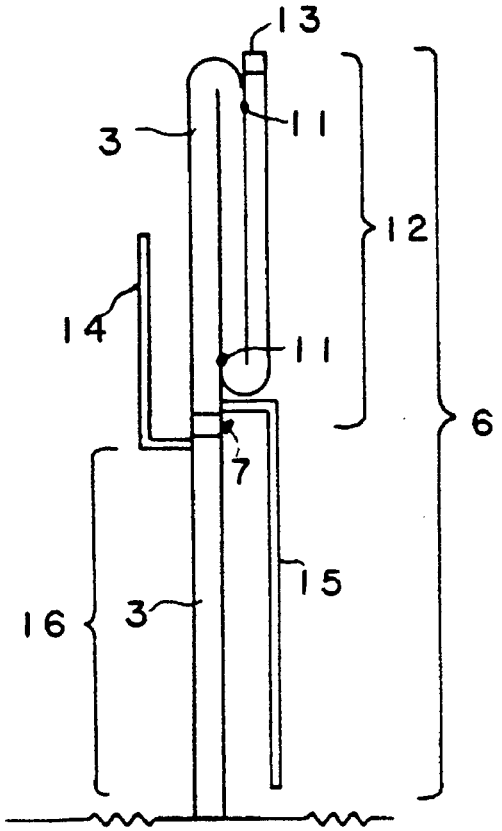
FIG. 5 is a side view functional of a multi-band vertical antenna, wherein the upper portion employs an extended length of coaxial cable to create the necessary inductive reactance and also employs two tuning rods to assist in coupling and matching on the various operating bands.

The previously discussed, single band configurations do not exhaust the many potential applications of the gap radiated antenna. When applied to a set of multiband requirements, the gap radiated antenna results in an extremely unique and efficient multiband radiator. The embodiment illustrated in FIG. 5 is adapted for multiband operation on the 80/75 meter, 40 meter, 20 meter, 15 meter, and 10 meter bands. As previously discussed, these are the major bands utilized by amateur operators. However, by adapting the principles discussed or utilized in developing multiband operation on the bands selected, multiband gap radiated antennas can be developed for use on a wide variety of frequencies and combinations of frequencies. Thus, this discussion is illustrative only, and does not limit the potential application of the multiband present antenna to the configuration or frequencies discussed.

A review of FIG. 5 reveals numerous differences between this configuration and the multiband and single band (including gap radiated single band) antennas previously discussed. First, unlike typical single and multiband antennas, it is not energized at the base, but is gap fed from its midpoint as is the typical single band gap radiated antenna. As will be understood, the location of the gap 7 midway up the antenna places the feed point for the upper three bands in the optimum position, allowing total utilization of the available antenna length, while retaining total utilization on the lower two bands as well. Second, while the overall height of the vertical component 6 (approximately 32 feet) is similar to the height of a typical multiband trap vertical, it is free of traps and other features generally associated with such antennas. Third, the upper portion 12 of the antenna is approximately 47 feet long and folded in the manner described in discussing the configuration illustrated in FIG. 3 so as to remain within the vertical boundaries of the upper portion 12. Fourth, the braid 3 is not shorted to the inner wire 5 as was the case with the single band antenna previously discussed. Instead, a capacitor 13, has been placed in the circuit at this point and is connected to the braid at one end and the inner wire at the other end. Fifth, it is possessed of an upper tuning rod 14 having a vertical length of approximately 7.5 feet and a lower tuning rod 15 having an overall vertical length of 15.5 feet that assist it to function efficiently on the bands selected. Other elements will be identifiable or understood from the prior analysis of single band configurations. Thus, discussion of this embodiment of the invention will focus on those features, quantities and qualities that are critical to understanding its function on the various bands selected.

On the 75/80 meter band (3.5 to 4 mhz), analysis and operation of the antenna is analogous to that of a single band gap radiated antenna with two exceptions: the utilization of the capacitor 13 and of the lower tuning rod 15 in the design. In the prior embodiments described, the braid 3 was either shorted to the inner wire 5, or this connection was left open. In the multiband configuration, this is not feasible. If the braid 3 and the inner wire 5 were shorted, and its length was selected to provide the necessary inductive reactance to nullify the capacitive reactance created by the shortened antenna height (i.e.—at 75/80 meters, the antenna is only 50% of the desired ¼ λ height of 60 feet), the resultant value of inductive reactance would be less than that required for the upper bands. Thus, the length of the upper portion 12 of the antenna having been chosen to create the inductive reactance suitable for operation on the highest bands, it is necessary to provide a capacitive reactance in the line that will nullify a portion of this reactance when operating on the lower bands, but has little effect on the system while operating at the higher frequencies selected.

Terminating the antenna with a capacitor in the 1500 pf range provides the correction necessary. The capacitive reactance $X_c$ decreases as the frequency increases in accordance with the previously cited equation $X_c = \frac{1}{2} \pi fC$. Thus, at the value chosen, the capacitor nullifies the excess inductive reactance at lower frequencies, having less and less effect as the frequency is raised, and ultimately approaches a short at 28 mhz.

The lower tuning rod 15 provides a means of increasing antenna resistance on the 75/80 meter band. It allows a portion of the current in the upper portion 12 of the antenna to flow in the opposite direction of the current flow in the lower portion 16 of the antenna, thereby reducing the net current on the vertical component 6 and elevating the antenna resistance. Operating in this manner, the overall vertical length selected creates an antenna resistance of 52 ohms, providing an ideal match for the chosen transmission line impedance. The band width achieved exceeds 150 khz, approximately 300% greater than the 50 khz bandwidth typically achieved by a one-half height trap vertical.

When operating on the 40 meter band, the antenna height of 32 feet is equal to the ¼ λ height for a standard vertical dipole. Thus, there is no capacitive reactance from a shortened antenna to counteract inductive reactance. However, the capacitor 13 provides capacitive reactance at the values chosen to counterbalance the inductive reactance. The lower tuning rod 15 also continues to effect the system at this wavelength. However, the increase in antenna resistance is minimal, allowing the antenna to operate at a voltage standing wave ratio ("VSWR") of less than 1.5 to 1, with an antenna resistance in the region of 70 ohms, a near match to the chosen line impedance.

At twenty meters, inductive and capacitive reactance for the system remain approximately balanced. The 32 foot antenna height is equivalent to that of a full ½ λ vertical dipole. Thus, radials are no longer necessary to properly function. Indeed, the concern at this wavelength is that the antenna is grounded. In a conventional ½ λ vertical dipole, the base must be isolated from the ground for the antenna to function properly. In the multiband gap radiated antenna illustrated, the lower tuning rod 15 provides a means for operating the antenna in this situation. The lower tuning rod 15 interacts with the portion of the antenna below the gap 7 to create a balanced current flow both above and below the gap 7 and a matched VSWR condition approaching 1:1 to 1 at band center. Substantially all of the available energy is by definition, therefore, radiated. Performance equivalent to that of a conventional vertical dipole has been confirmed by measurement. Further, the antenna provides 4 to 5 Db of gain relative to full height ¼ λ verticals with excellent low angle coverage, and even more substantial gains in performance when compared to the shortened ¼ λ vertical produced by multiband trap antennas.

At 15 meters, inductive reactance and capacitive reactance remain balanced. The gap 7 is ⅜ λ from the top and ⅜ λ from the base of the antenna. On this band, the upper tuning rod 14 becomes important to function, adjusting current flow on the upper portion 12 of the vertical component 6 so as to produce a matched condition and illuminate the entire ¾ λ height of the vertical component 6. On the bands previously analyzed, the upper tuning rod 14 had virtually no effect on performance due to its short length in comparison to the operative wavelength and the length of other radiating elements. At 15 meters it is the lower tuning rod that now becomes ineffective due to its excessive height/length when compared to the operative wavelength. Aside from these differences, function and overall measured performance gains on this band are comparable to those experienced on the 20 meter band.

On the 10 meter band the various elements of the antenna interact such that the upper tuning rod 14 and the lower portion 16 of the vertical component 6 are energized 90 degrees from the lower tuning rod 15 and the upper portion 12 of the vertical component 6. The net pattern and function of the elements operating in this manner are, therefore, extremely difficult to analyze. The most probable result of this situation is to produce the functional equivalent of a two element colinear array with 90 degree phase shift. However, the net effect is to produce an antenna resistance of 50 ohms (a near perfect match) and a performance overall equivalent to a ½ λ vertical dipole, with gains approaching 10 db over standard multiband trap verticals operating at this wavelength.

The functional diagram provided in FIG. 5 exaggerates certain features and dimensions of the vertical component 6 of the antenna for the purposes of clarity when reviewing same in conjunction with the description thereof.

Figure 6:
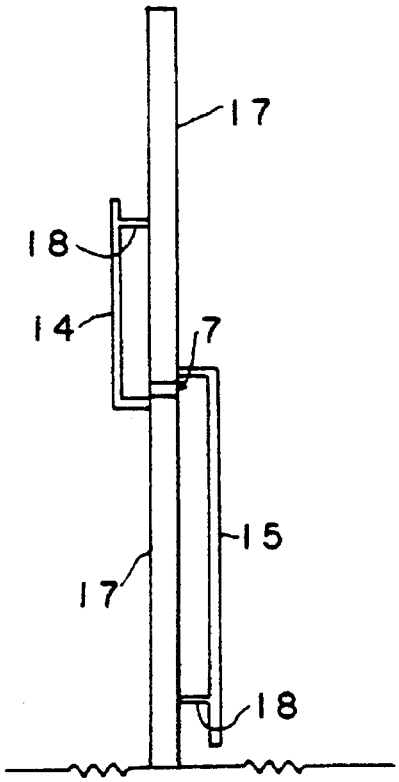
FIG. 6 is a side view of a multi-band vertical antenna, wherein the coaxial elements of the antenna have been enclosed in rigid, aluminum tubes to achieve a self-standing capability.

A more accurate representation of the external appearance of the vertical component 6 of the gap radiated multiband antenna is presented in FIG. 6, which illustrates the appearance of same from the side with most of its operative elements encased in two sections of 1.5 inch aluminum tubing 17, which are provided for support purposes. Additional support features illustrated are the insulated standoffs 18 which help stabilize and support the upper tuning rod 14 and the lower tuning rod 15. The gap 7 is not covered by the aluminum tubing 17. It should also be noted, as previously discussed, that the lower portion 16 of the present multiband antenna can be directly grounded, even when functioning as a full ½ λ vertical dipole. Thus, mounting the antenna is greatly simplified as the aluminum tubing 17 that serves to stiffen and support the structure can be directly attached to an anchoring tube or other structure placed or buried in the ground. The aforesaid discussion is not, however, to be taken in any way as limiting the invention or the possible means of support for the antenna. It merely illustrates a means of support found to be advantageous by the inventor.

Figure 7:
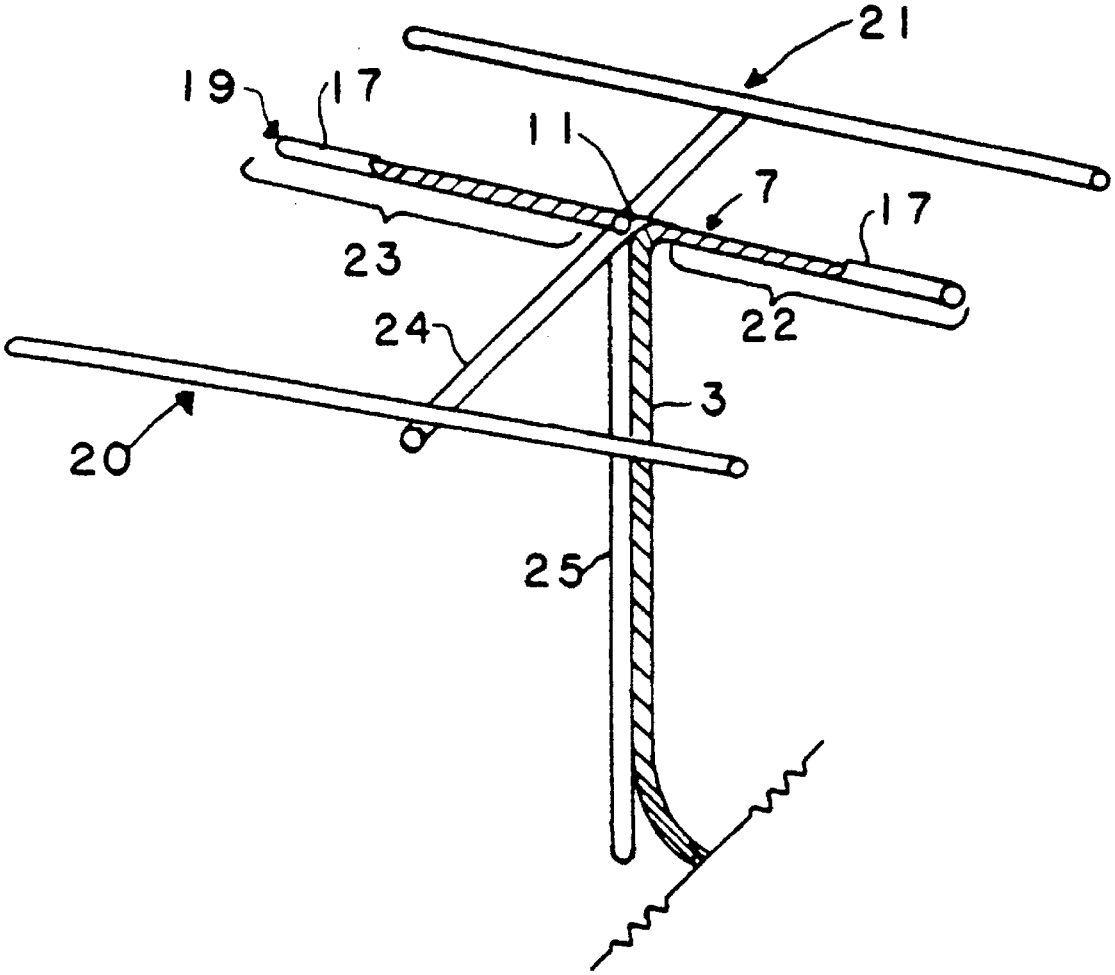
FIG. 7 is a three-element, horizontal beam, wherein the driven element is asymmetrically gap-fed and the entire structure is grounded.

FIG. 7 gives a perspective view from the top and side of a three element beam configuration incorporating a gap fed driving element 19, as taught by this invention, a reflector 20 and a director 21. A conducting connector 11 is provided to connect gap bearing portion 22 of the driving element 19 to the non-gap bearing portion 23 of the driving element 19. Utilization of a gap fed driving element allows all of the aforesaid directive array elements of the antenna to be directly attached to the boom 24 and in turn, to the supporting mast 25. Direct grounding eliminates the need for structural insulators, or baluns, gamma, delta, omega or T matching systems. Further, close spaced beams present very low value of antenna resistance because of mutual coupling effects and require transformation networks to match a 52 ohm transmission line. The gap driven multibeam, using the techniques previously described, allows direct selection of the antenna resistance by proper positioning of the gap 7, thereby avoiding the need for transformation networks. The simplicity inherent in this design reduces manufacturing, assembly and tuning rod costs and improves adverse weather reliability since no discrete matching devices are needed.

Figure 8:
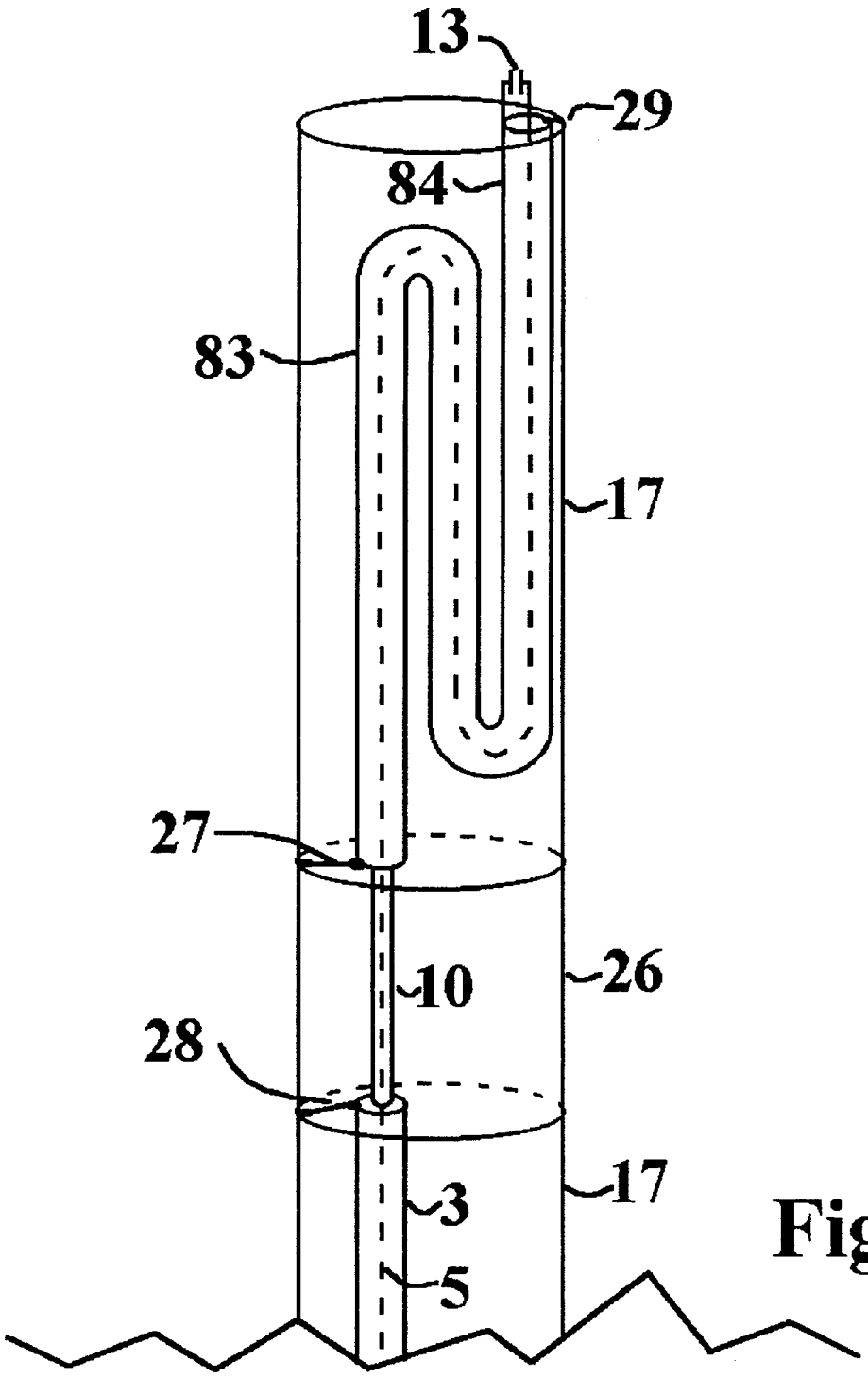
FIG. 8 is a perspective view of the upper section of the gap radiating antenna with the exterior structure (the aluminum tubing) in phantom.

FIG. 8 is a phantom view of the upper section of the gap antenna depicting the interconnections between the coaxial cable 83, heavy outside conductive braid or shield 84, and the aluminum tubes 17 and center insulting tube 26. The top of the coaxial cable 83 (specifically shield/braid 84) is electrically connected to the top of the upper aluminum tube by conductor wire 29. The capacitor 13 is connected from the coaxial cable 83 center conductor 5 to the coax shield 84. An insulating tube 26 mechanically connects the upper aluminum tube 17 (preferably 16 feet in length and 0.06 wave lenth at the lowest frequency) with its lower counterpart also 17 (preferably 15.5 feet and 0.59 wave length at the lowest frequency). This tube is non-conductive, such as PVC or the equivalent. The braid 84 gap formed by a separation break in the coaxial cable peipheral conductive braid 84 coaxial insulator 10 is positioned coincident with the insulating section 26. Note, the braid 84 immediately above the gap is electrically connected to the aluminum tube by wire 27 and the coax braid 84 immediately below the gap is electrically connected to the adjacent aluminum tube below the gap with wire 28. Finally, FIG. 8 shows two loops in the coax 83 (preferably 49 feet physically and 72 feet electrically with a velocity factor of 0.68). In some applications, five or more loops may be required to fit the coax within the upper aluminum tube 17. Preferably the total length of the coax within both tubes 17 is 65 feet physically and 95.5 feet electrically and the length of the coax within the lower tube is 15 feet physically and 22 feet electrically, with a velocity factor of 0.68.

Figure 9:
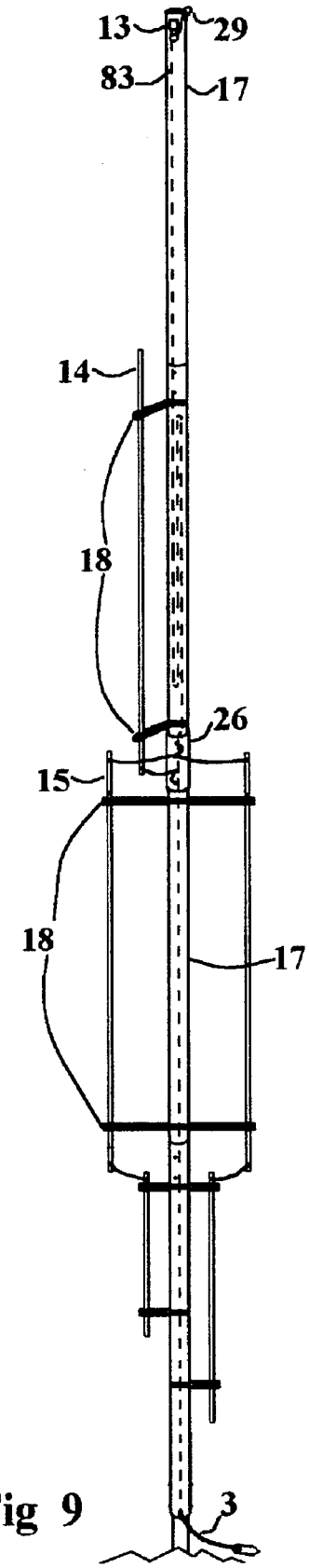
FIG. 9 shows a front elevational view of the gap radiated, multi-band antenna.
Figure 9A:
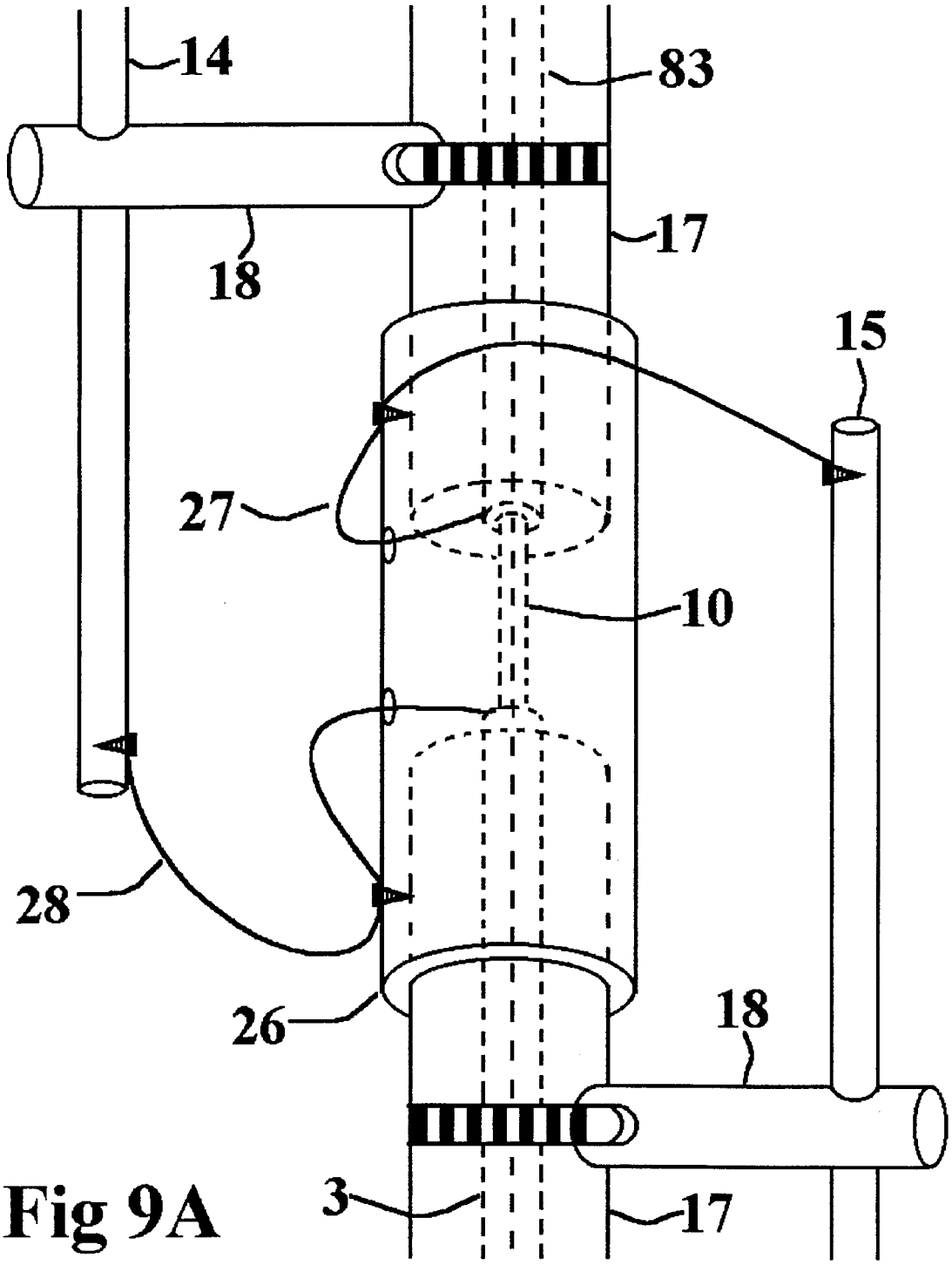
FIG. 9A is a cutaway view, partially in perspective, of the center portion of the antenna shown in FIG. 9.

FIG. 9 is an alternate embodiment of the gap multiband antenna. This antenna is matched for optimal 50 ohm operation on eight of the prime amateur frequency bands—80, 40, 20, 15, 12, 10, 6, and 2 meters. The antenna is 31.5 feet in height, weighs 18 pounds and employs telescoping aluminum tubing 1.125" diameter at the top, 1.25" diameter in the center, and 1.375" diameter at its lower section. The center insulator 26 is a 16" section of PVC tubing which connects the 1.25" tubes above and below the gap. The figure shows two gap leads 27, 28 from the coax braid 83 on either side of the coaxial insulator 10 that are attached to the aluminum tubing 17 as shown in FIG. 8.

A top tuning rod 14 is placed parallel to the aluminum tubing 17 and secured in place 7" from the aluminum tubing 17 by PVC standoffs 18 which are in turn secured to the aluminum tubing 17 with stainless steel hose clamps. The lower end of the top tuning rod 14 is electrically attached (wire) to the aluminum tube 17 immediately below the gap as shown in FIGS. 5, 6, and 8.

Two lower tuning rods 15 are employed. The additional tuning rod not shown in FIGS. 5 and 6 provides an additional operating band, i.e. 12 meters not included in the FIG. 5/6 descriptions. The length of the two rods is ½×153" and ½"×124".

Note that the spacing of these tuning rods 15 from the aluminum tube 17 is not constant. The upper 102" of each is spaced 7" from the aluminum tube 17 using identical standoffs 18 as employed with the top tuning rod 14. The remaining bottom portion of these rods is spaced 3" from the aluminum tube 17. The change in spacing is not mandatory. It spatially concentrates the rf feedback and expands the usable bandwidth on 12, 20, and 80 meter bands. The size and location of the aluminum, hollow tuning rods 14 and 15 are governed by electrical and structural considerations. Very close spacing (less than 3") encourages "arc over," particularly when the antenna is operating in wet weather or in proximity to a salt water environment, and also makes it difficult to maintain spacing when the mast flexes due to heavy winds. Additional standoffs 18 and/or restraining guys 31 are required to eliminate mast flex. Typically, the rod diameter, being hollow, is limited to ½".

The tuning rods serve multiple purposes in the gap antenna. The length of the lower tuning rod 15 is dictated by the requirement to form a one-half wavelength antenna on the 20 meter band, measured from the top of the antenna to the bottom of the tuning rod 15. This same tuning rod 15 provides negative feedback (out of phase) rf on the 80 meter and 40 meter band, increasing antenna resistance at the gap 7 to the desired 50 ohms. A second, lower tuning rod on the antenna in FIG. 9 forms a one-half wavelength antenna on 12 meters, measured from the top of the antenna to the bottom of the tuning rod.

The upper tuning rod 14 serves as a one-fourth wavelength element on 10 meters and an open sleeve feed for the 15 meter band. The ratio of mast diameter (large) to rod diameter (small) follows the trend of decreasing antenna feed point resistance. The specifics of 7" spacing and 3" spacing between the tuning rods and the mast were derived empirically.

Electrically, the antenna is capable of radiating 1500 watts of power. The 2:1 VSWR bandwidth of operation is as follows:

Band 1 - 80 meters>135 khz (total band 500 khz)

Band 2 - 40 meters>500 khz (total band 300 khz)

Band 3 - 20 meters>700 khz (total band 350 khz)

Band 4 - 15 meters>700 khz (total band 450 khz)

Band 5 - 12 meters>200 khz (total band 100 khz)

Band 6 - 10 meters>1 mhz (total band 1.8 mhz)

Band 7 - 6 meters>2 mhz (total band 4 mhz)

Band 8 - 2 meters>2 mhz (total band 4 mhz)

The gap antenna requires three (but at least two) 25-foot radials. Adding additional radials will not affect performance. Earth loss is virtually eliminated because the gap feet point is 16 feet above ground. The coax length above the gap is 47 feet as previously described and terminated in capacitor 13 as previously described.

Figure 10:
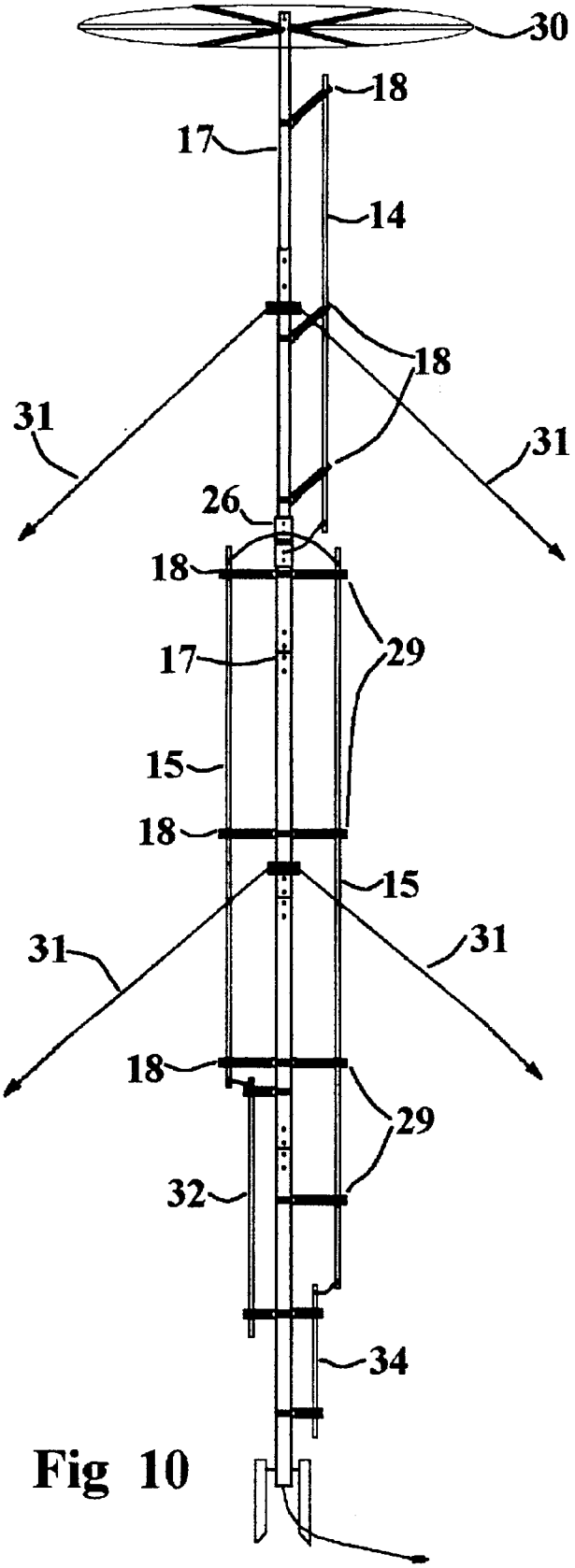
FIG. 10 shows a front elevational view of an alternate embodiment of the gap radiated, multi-band antenna.

FIG. 10 depicts another embodiment of the gap multiband antenna. This gap antenna is matched for 50 ohm optimal operation on four of the prime amateur bands—160, 80, 40, and 20 meters. The antenna is 45 feet in height, weighs 35 pounds, and employs telescoping aluminum tubing 1.375" diameter at the top, 1.50" diameter in the center, and 2.0" tubing in the lower section. The center insulator 26 is a 16 inch section of fiberglass which encases the 1.50" aluminum tubing on either side of the gap 7. The gap 7 is positioned 29 feet above the base. 93 feet of coax 83 are folded above the gap 7 and terminated in a capacitor of 5500 pf nominally. Gap electrical connections are identical to those described in FIGS. 5, 8, and 9.

A ½×16' top tuning rod 14 is placed parallel to the top section 17 and secured in place 7" from the top section 17 with PVC standoffs 18 and stainless hose clamps. The lower end of the top tuning rod 14 is electrically attached to the lower tube 17 as previously described.

Two lower tuning rods 15 are employed. One is ½×25.5' in length, the other is ½×27.8' in length. The shorter rod is placed parallel to the lower tube 17 and secured with 7" standoffs 18 placed parallel to the lower tube 17 and is secured with 12" standoffs 29.

A 102" lower portion 32 of the shorter rod 15 is placed 3" from the lower tube 17 and a 65" lower portion 34 of the longer rod 15 is also placed 3" from the lower tube 17. The close spacing is not mandatory but expands the usable antenna bandwidth as previously described.

The antenna is capable of radiating 1500 watts of power. The 2:1 VSWR bandwidth of operation is as follows:

| Band | 2:1 Bandwidth | Reg. Bandwidth |
|---|---|---|
| 160 | >90 khz | 200 khz |
| 80 | >500 khz | 500 khz |
| 40 | >700 khz | 300 khz |
| 20 | >700 khz | 350 khz |

The gap antenna utilizes three 57-foot radials. Adding additional radials does not affect antenna efficiency because earth loss is virtually eliminated since the gap feed point is 29 feet above ground level.

In order to maintain an overall height of 45 feet when 66 feet is required, a capacitance hat 30, 8" in diameter, has been employed. To maintain verticality in 80 mph winds, two sets of guys 31 (insulated) are required.

Figure 11:
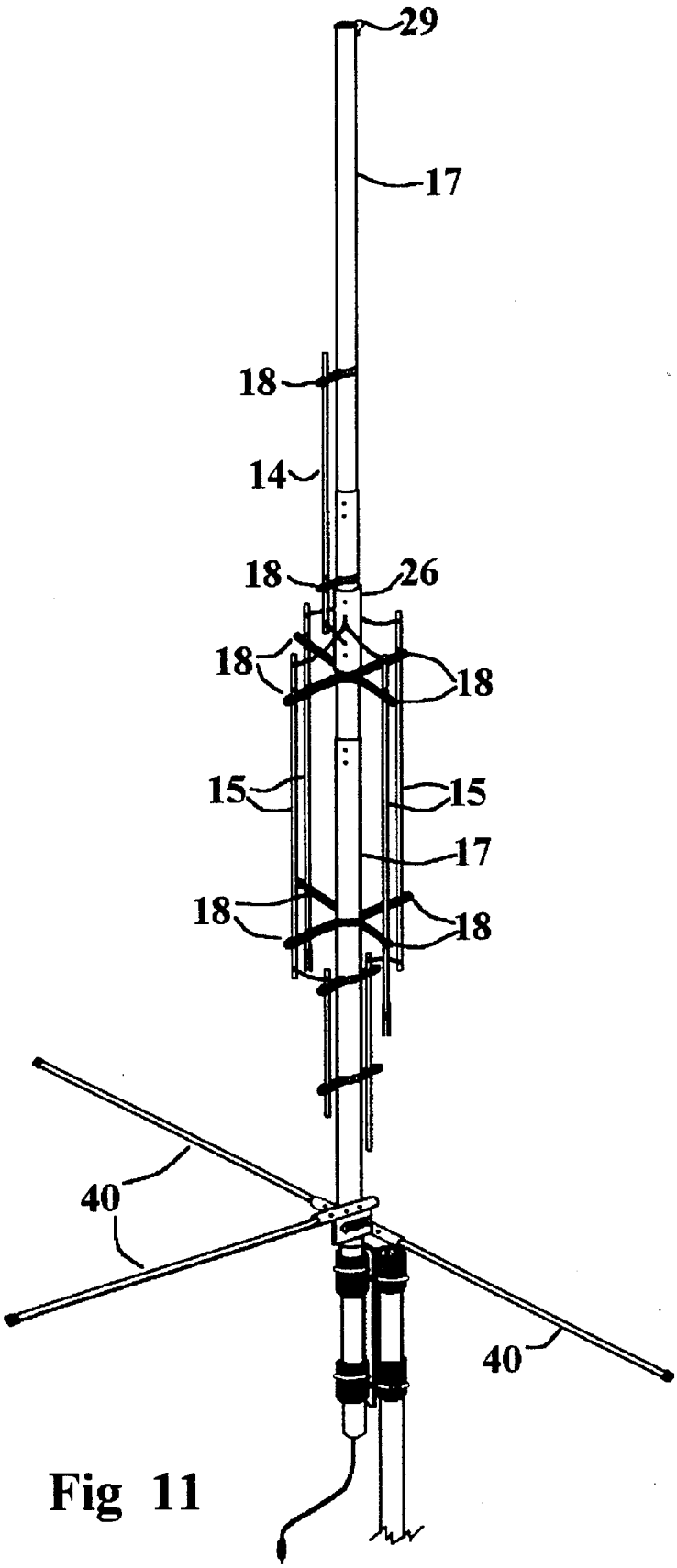
FIG. 11 shows a front elevational view of an alternate embodiment of the gap radiated, multi-band antenna.

FIG. 11 is another embodiment of the gap multiband antenna. This antenna is matched for optimal 50 ohm operation on six of the prime amateur bands—40, 20, 17, 15, 12, and 10 meters. The antenna is 21 feet in height and weighs 19 pounds and employs telescoping aluminum tubing 17 1.125" diameter at the top, 1.25" diameter in the center, and 1.375" diameter at the bottom. The center insulator 26 is a 16" section of PVC tubing which covers the 1.25" tubes 17 above and below the gap. The gap electrical connections are identical to those described in FIGS. 8 and 9.

A 65-inch top tuning rod 14 is placed parallel to the top section 17 and secured in place 3" from the top section 17 with PVC standoffs 18 and stainless hose clamps. The lower end of the top tuning rod 14 is electrically attached to the lower mast 17 as previously described.

Four lower tuning rods 15 are employed.

a 92" rod×½";

a 107" rod×½";

a 113" rod×½"; and a 117" rod×½".

The 92" rod and the 107" rod are spaced 7" from the lower tube 17 and held in place with 7' PVC standoffs and stainless steel hose clamps.

The 113"×½" rod and the 117"×½" rod are spaced 7" from the lower tube 17 for 92". The remaining lower portions 21"

and 25" are spaced 3" from the lower tube 17. They are attached with PVC standoffs and stainless hose clamps. The rationale for closer spacing has been previously discussed. The four tuning rods 15, in order of increasing length, operate on 10, 12, 15, and 17 meter bands, respectively. The length of coax 113 above the gap is 24'3", is folded as previously described, and terminated in a capacitive value of 470 pf. as previously described.

The lower aluminum tubes which are not placed directly in the earth of the antenna are attached three rigid radials, i.e. counterpoise 4*c*. The counterpoise rods 4*c* are ½"×80" in length. The counterpoise and the entire vertical structure 17 permit operation on the 20 meter band. The entire vertical structure 17 and counterpoise 4*c* operate on the 40 meter band with the additional inductance provided by the coaxial cable 113 folded above the gap as previously described.

The antenna is capable of radiating 1500 watts pep power. The 2:1 VSWR bandwidths are as follows:

| Band | 2:1 Bandwidth | Desired Bandwidth |
|---|---|---|
| 40 m | >300 khz | 300 khz |
| 20 m | >500 khz | 350 khz |
| 17 m | >300 khz | 100 khz |
| 15 m | >500 khz | 450 khz |
| 12 m | >300 khz | 100 khz |
| 10 m | >500 khz | 1.9 mhz |

Thus, in multibeam configuration as elsewhere, the gap radiated antenna provides extraordinary benefits. Moreover, in this area of antenna design, as in those previously discussed the embodiments set forth and described herein are illustrative only. Numerous changes and variations are possible without exceeding the ambit of this invention.

What is claimed is:

1. An HF/VHF/UHF frequency RF antenna for transmitting and receiving RF signals of at least two or more discrete, predetermined frequencies, each at a high signal resonance without a trap or coil for matching or loading comprising:

a first, rigid linear electrically conductive metal tube, sized in length 16 feet and 0.06 wave length at the lowest fundamental frequency and having a proximal end and distal end;

a second, rigid linear electrically conductive tube, sized in length 15.5 feet and 0.059 wave length at said lowest frequency, having a proximal end and a distal end;

a rigid electrical insulator, physically connected to said first conductive tube at its proximal end and to said second conductive tube at its distal end, such that said first conductive tube and said second conductive tube are collinear along a longitudinal axis and are each joined to said rigid electrical insulator which separates said first conductive tube from said second conductive tube, said first and second conductive tubes and said first insulator forming a rigid linear support;

a coaxial cable 65 feet in physical length and 95.5 feet electrically in length created by a coaxial cable velocity factor of 0.68, having a first linear segment mounted inside said first conductive tube and a second linear segment mounted in said second conductive tube;

at least two conductive radials, each having a distal end and a proximal end connected conductively to said second conductive tube and sized in length 25 feet and 0.096 wave length at said lowest frequency;

said coaxial cable having said first linear segment 49 feet physically in length and 72 feet electrically created by a coaxial cable velocity factor of 0.68 mounted in said first tube and said second linear segment 15 feet physically and 22 feet electrically created by a velocity factor of 0.68 mounted in said second conductive tube, said coaxial cable having a center conductor extending from a first proximal end to a second distal end and an electrical coaxially insulator coaxially surrounding said center conductor throughout and a peripheral conductor coupled peripherally around said insulator coaxially surrounding said center conductor, said coaxial cable peripheral conductor having first and second conductive segments non-conductively separated forming an insulated gap;

first and second electrical connecting means connecting said peripheral first and second conductive segments of said coaxial cable respectively to said first conductive tube and said second conductive tube at the insulated gap, said insulated gap being positioned within the rigid linear support between said first conductive tube and second conductive tube;

a first linear conductive tuning rod electrically connected to said first tube in close proximity to the insulated gap and parallel to said first and second conductive tubes, said tuning rod 12.75 feet nominally in length and 0.05 wave length in length at the fundamental frequency and having a substantial portion of said tuning rod being spaced adjacent said second conductive tube, said first linear conductive tuning rod spaced 7 inches and 0.003 wave length from said second conductive tube, said first linear conductive tuning rod having a diameter nominally ¼ to ⅛ the diameter of the second conductive tube; and means connected to said coaxial cable peripheral conductor and said coaxial cable center conductor, attachable to an RF transmitter and receiver whereby said antenna can transmit and receive at least two HF or UHF or VHF frequencies at or near resonance wherein the antenna resistance is matched to the characteristic impedance of the coaxial cable and wherein minimal earth loss is introduced to the antenna.

2. An antenna as in claim 1, wherein:

said antenna is mounted vertically relative to the surface of the earth.

3. An antenna as in claim 2, wherein:

said coaxial cable first peripheral segment mounted within said first conductive tube and oriented in a side-by-side, looped, back and forth disposition in said first tube to increase the physical length of said first coaxial cable segment, said 49 feet of said first peripheral conductor of said coaxial cable mounted within said 16 feet of first tube.

4. An antenna as in claim 3, wherein:

a distal end of the peripheral conductor of said coaxial cable first segment is electrically connected to the distal end of said first conductive tube, and wherein said distal end of the first peripheral conductor of said coaxial cable first segment is also electrically connected to the distal end center conductor of the coaxial cable by a capacitor.

5. An antenna as in claim 4, including:

second linear tuning rod electrically connected to said second rigid linear conductive tube in close proximity to the insulated gap and disposed parallel to said second rigid linear conductive tube and said first rigid linear conductive tube and having a substantial portion of said second linear tuning rod adjacent said first rigid linear conductive tube.

* * * * *